US006898839B2

(12) United States Patent
Katoh et al.

(10) Patent No.: US 6,898,839 B2
(45) Date of Patent: May 31, 2005

(54) MULTI-LAYERED BRUSH OF ROTARY ELECTRIC MACHINE AND METHOD OF MANUFACTURING THE SAME

(75) Inventors: Masahiro Katoh, Chiryu (JP); Masanori Ohmi, Anjo (JP)

(73) Assignee: Denso Corporation, Kariya (JP)

( * ) Notice: Subject to any disclaimer, the term of this patent is extended or adjusted under 35 U.S.C. 154(b) by 261 days.

(21) Appl. No.: 10/345,359

(22) Filed: Jan. 16, 2003

(65) Prior Publication Data

US 2003/0079340 A1 May 1, 2003

Related U.S. Application Data

(62) Division of application No. 09/788,426, filed on Feb. 21, 2001.

(30) Foreign Application Priority Data

Feb. 22, 2000 (JP) ..... 2000-44626

(51) Int. Cl.[7] ..... H01R 43/10

(52) U.S. Cl. ..... 29/597; 29/592.1; 29/825; 29/875; 29/878

(58) Field of Search ..... 29/825, 592.1, 29/597, 875, 878, 879

(56) References Cited

U.S. PATENT DOCUMENTS

| | | | | |
|---|---|---|---|---|
| 656,651 A | | 8/1900 | Markey | |
| 656,652 A | | 8/1900 | Markey | |
| 672,449 A | | 4/1901 | Markey | |
| 2,783,405 A | | 2/1957 | Atkins et al. | |
| 3,046,425 A | | 7/1962 | Millet | |
| 3,300,667 A | | 1/1967 | Boes et al. | |
| 3,303,370 A | | 2/1967 | Boes et al. | |
| 3,714,482 A | | 1/1973 | Lace | |
| 4,000,430 A | | 12/1976 | Bely et al. | |
| 4,324,997 A | | 4/1982 | Taylor et al. | |
| 4,325,734 A | * | 4/1982 | Burrage et al. | 419/60 |
| 4,687,515 A | * | 8/1987 | Talento | 75/246 |
| 4,927,989 A | * | 5/1990 | Naya et al. | 200/265 |
| 5,168,620 A | | 12/1992 | Denney et al. | |
| 5,285,126 A | | 2/1994 | Hoffmann et al. | |
| 5,350,004 A | * | 9/1994 | Rocazella et al. | 164/97 |
| 5,387,831 A | | 2/1995 | Yang | |
| 5,441,683 A | | 8/1995 | Kammerer et al. | |
| 5,505,248 A | * | 4/1996 | Aghajanian et al. | 164/97 |
| 5,585,190 A | * | 12/1996 | Newkirk et al. | 428/469 |
| 5,630,973 A | * | 5/1997 | Hoell et al. | 264/105 |
| 5,701,046 A | | 12/1997 | Kammerer et al. | |
| 5,712,522 A | | 1/1998 | Niimi | |
| 5,744,889 A | | 4/1998 | Niimi | |
| 6,222,298 B1 | * | 4/2001 | Saito et al. | 310/233 |
| 6,674,212 B2 | * | 1/2004 | Inukai et al. | 310/223 |

FOREIGN PATENT DOCUMENTS

| | | |
|---|---|---|
| DE | 2838144 A1 | 3/1980 |
| FR | 2009196 A1 | 1/1970 |
| FR | 2339263 A1 | 1/1976 |
| JP | 2-86081 | 3/1990 |
| JP | 402094381 A | 4/1990 |
| RU | 1820990 A3 | 6/1993 |
| WO | 90/07211 A1 | 6/1990 |

* cited by examiner

*Primary Examiner*—Carl J. Arbes
(74) *Attorney, Agent, or Firm*—Oliff & Berridge, PLC

(57) ABSTRACT

A brush of a rotary electric machine includes a brush element and a pigtail. The brush element includes a high-conduction member extending in the longitudinal direction and a low-conduction member bonded to a side of the high-conduction member. The low-conduction member is a thin layer extending in the longitudinal direction from the contact surface to the middle of the length of the brush element. The wire end is embedded in the high conduction member on the side of the low-conduction member remote from the contact surface.

3 Claims, 6 Drawing Sheets

MULTI-LAYERED BRUSH OF ROTARY ELECTRIC MACHINE AND METHOD OF MANUFACTURING THE SAME

CROSS REFERENCE TO RELATED APPLICATION

The present application is based on and claims priority from Japanese Patent Application 2000-44626 filed Feb. 22, 2000, the contents of which are incorporated herein by reference.

BACKGROUND OF THE INVENTION

1. Field of the Invention

The present invention relates to a multi-brush of a rotary electric machine and a method of manufacturing the brush.

2. Description of the Related Art

JP-A-9-49478 or its corresponding U.S. Pat. No. 5,712,522 discloses a brush formed of a thick high-conduction member and a thin low-conduction member, which are bonded together.

Although there is no showing in the above publication how to connect the pigtail to the brush, this is very important to the performance of the rotary electric machine. If the pigtail is connected to the high-conduction member of the brush element, the connection resistance is low so that a good connection characteristic can be provided. On the other hand, if the pigtail is connected to the low-conduction member, the connection resistance is high, resulting in a bad connection characteristic. Because the pigtail that is inserted into the brush element from the low-conduction-member-side contacts the low-conduction member, the connection resistance becomes high, and the rotary electric machine having such a brush operates at a low efficiency. In addition, joule heat of the connection resistance may cause overheating problems.

In order to prevent the above stated problems, there is an idea that the pigtail is inserted into a deep hole of the brush element extending to the high-conduction member. However, when the pigtail is inserted in the deep hole, the low-conduction member may stick to the outer periphery of the pigtail. This increases the connection resistance, resulting in the above-stated problems. In addition, a variety of the sticking conditions of the low-conduction member to the pigtail causes a variety of the connection resistances, resulting in unstable operation. It is sometime inevitable that the pigtail is inserted to the brush element from the low-conduction member.

In order to prevent the connection resistance from increasing too much, a brush and a method of manufacturing such a brush are proposed in JP-A-2-86081. The pigtail is covered with a columnar (cylindrical or rectangular) high-conduction cover so that the pigtail is embedded into the high-conduction member without contacting the low-conduction member, thereby to reduce the connection resistance.

However, the portion of the low-conduction member surrounding the pigtail has to be removed to form such a columnar high-conduction cover. This necessitates two steps of pressing and hardening powder material in order to form the brush element. As a result, the manufacturing process becomes complicated and expensive.

SUMMARY OF THE INVENTION

Therefore, the present invention is to solve the above stated problems by providing a stable and inexpensive brush having a low connection resistance that has a pigtail inserted from the low-conduction-member-side into the brush element.

According to a feature of the invention, a brush is comprised of a brush element formed of a high-conduction member and a low-conduction member bonded to each other and a pigtail having a wire end embedded in the brush element.

The brush has the following features. Firstly, the low-conduction member is a thin plate that is bonded to the high-conduction member at a front surface near a contact surface of the brush element to be in contact with a commutator of the rotary electric machine. Secondly, the wire end is embedded in a portion of the brush element's side surface that is formed of the high-conduction member and positioned remote from the contact surface and separate from the low-conduction member.

It is not necessary that the low-conduction member has an even thickness as far as it is thinner than the brush element. It is desirable that the low-conduction member covers all the width of a surface of the brush element.

It is also desirable that the low-conduction member extends from the contact surface to a middle portion in the length of the brush element that corresponds to a maximum amount of abrasion of the brush element.

The wire end of the pigtail is embedded in the high-conduction member of the brush element on the opposite side of the low-conduction member remote from the contact surface.

Because the pigtail is not embedded in the low-conduction member but only in the high-conduction member, the connection resistance can be kept at a low level. Moreover, since only a partial surface of the high-conduction member is covered with a thin low-conduction member, the connection resistance of the pigtail can be kept at a low level, and the connection resistance does not disperse widely.

As a result, the pigtail can be inserted from the low-conduction-member-side to be embedded in the brush element at a low and even connection resistance.

In addition, the brush can be manufactured through a simple process.

Further, the brush element can be formed at a single punch or pressing-and-hardening step. As a result, the low-conduction member and the high-conduction member are strongly bonded to each other.

According to another feature of the invention, at least a peripheral portion of the pigtail is embedded in a surface portion of a side surface of the high-conduction member to which the low-conduction member is not bonded.

According to another feature of the invention, the brush element is formed through the following steps: forming a high-conduction powder into a stair shape having lower and upper steps, adding a low-conduction powder to the lower step to be flush with the upper step; pressing both high-conduction powder and low-conduction powder to form a mold; and sintering the mold.

Thus the brush element is formed from a powder at a single pressing-and-hardening step. Therefore, the manufacturing process can become simple and inexpensive.

The forming steps may include the following steps: filling the high-conduction powder into a female die to form a flat surface having a thickness corresponding to the brush, and scraping the flat surface from the contact surface to the middle of the length of the brush element. Therefore, the stair shape can be easily formed on the surface of the layer of the high-conduction powder by a movable member.

The forming step may also include the following steps: filing the high-conduction powder into the female die to form a flat surface having a thickness thinner than the brush and a step of covering the flat surface with another high-conduction powder extending from an end to the middle thereof to a thickness corresponding to the brush.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

Figure 1:
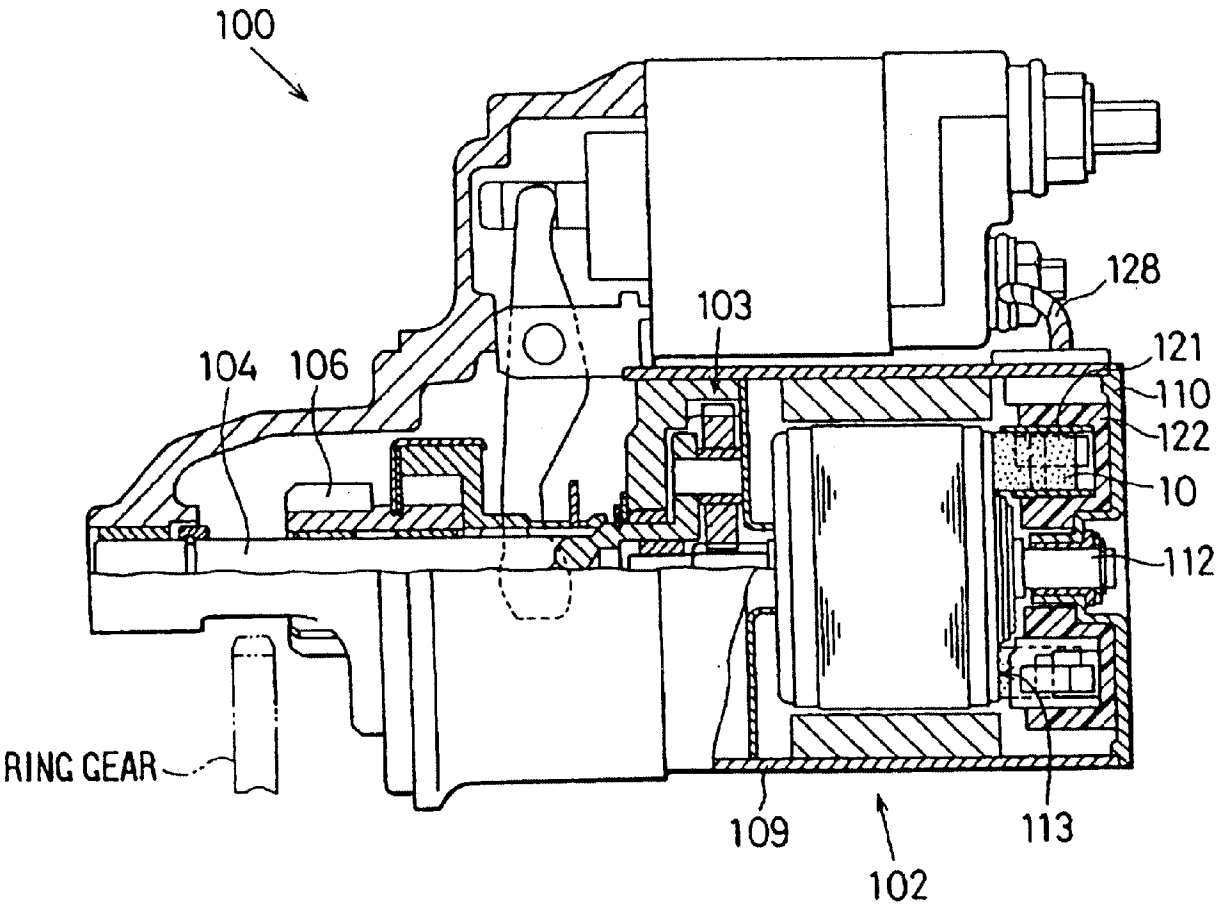
FIG. 1 is a cross-sectional side view of a starter to which a brush according to the invention is applied.
Figure 2:
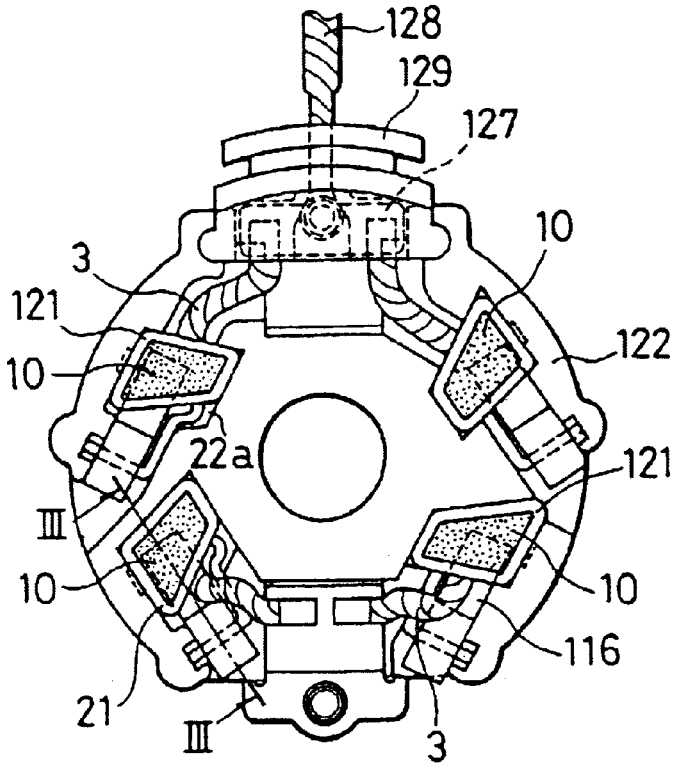
FIG. 2 is a front view of a brush holder unit of the starter shown in FIG. 1.

A brush according to a first embodiment of the invention is a part of a DC rotary electric machine such as a starter 100 shown in FIG. 1 that is in contact with a commutator 113.

Starter 100 is comprised of a DC motor 102, a reduction unit 103 for reducing rotation speed of motor 102, output shaft 104 for transmitting the torque of motor 102, pinion gear 106 which is engaged with a ring gear of an engine when engine is started, one way clutch 107 which transmits the rotation of output shaft 104 to a pinion gear 106, and magnet switch 108 which turns on or off motor's contacts (not shown) of a motor driving circuit (not shown). The output shaft 104 is disposed in front of an armature 114 to align with an armature shaft 112. A pinion gear 106 is slidably fitted to the outer periphery of the output shaft 104 so as to engage the ring gear, thereby transmitting the rotation of output shaft 104 to the ring gear.

Motor 102 is comprised of cylindrical yoke 109 made of soft iron, end frame 110, an armature 114 which has a face-contact commutator 113 and a brush holder unit 115.

Brush holder unit 115 is comprised of four cylindrical metal brush holders 121 and a resinous plate 122. Brush holder unit 115 has a pair of positive brush elements 10, a pair of negative brush elements 10, which are slidably held inside the brush holders 121. The brush elements 10 slidably contact a commutator 113, and the brush springs 116 respectively press the brush elements 10 against commutator 113.

Figure 3:
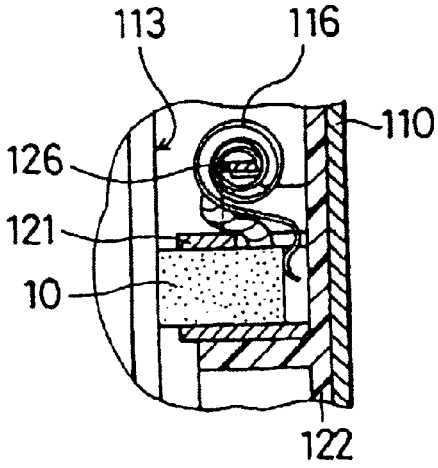
FIG. 3 is a cross-sectional view of the portion shown in FIG. 2 cut along line III—III.

Each of the brush elements 10 has a pigtail 3. Output lead wire 128 is connected to a metal member 127 and the magnetic switch 108. Each of the negative brush elements 10 also has the pig tail 3 which is connected to a ground. As shown in FIG. 3, each of the brush springs 16 is supported by support arms 126. Thus, spring force is accumulated in the spirally wound spring body so that brush elements 10 can be properly biased, even if the brushes are worn away until a worn-away or abrasion limit.

Figure 4A:
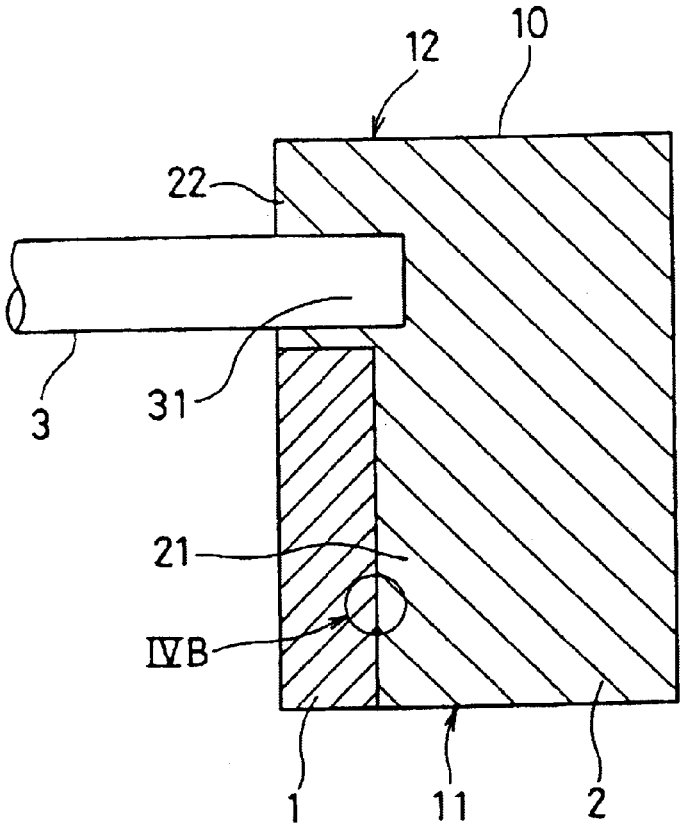
FIG. 4A is a longitudinal cross-sectional view of a brush according to a first embodiment of the invention and FIG. 4B is an enlarged cross-sectional view of a main portion of the brush.

As shown in FIG. 4A, the brush element 10 is comprised of a high-conduction member 2 and a low-conduction member 1 that is bonded to the high-conduction member 2. The high-conduction member 2 is a sintered copper alloy having a high conductivity. It can be called a low resistance member. On the other hand, the low-conduction member 1 is a low-conduction sintered material that includes filler powder such as a binding agent mainly composed of graphite. This can be called a high resistance member.

A contact surface 11 of the brush element 10 to be in contact with the commutator 113 is formed by a common end surface of the high-conduction member 2 and the low-conduction member 1.

The other or opposite surface 12 that is biased by the spring 116 is formed only by the opposite end of the high-conduction member 2.

Figure 4B:
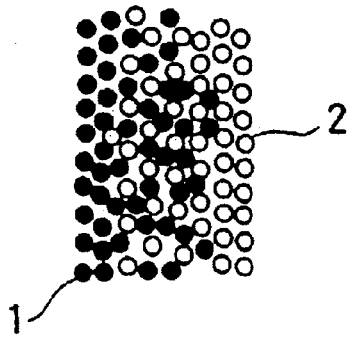

The low-conduction member 1 is a thin layer or plate that has an even thickness and is bonded to a concave side surface or lower step side surface 21 of the high-conduction member 2 near the contact surface 11 thereof. A wire end 31 of the pigtail 3 is embedded in an upper-step side surface 22 of the high-conduction member 2 that is remote from the contact surface 11 at a certain distance from the low-conduction member 1. The low-conduction member 1 covers the whole width of the side surface of the high-conduction member 2. The low-conduction member 1 extends from the contact surface 11 beyond a portion that corresponds to a maximum abrasion of the brush element 10. The low-conduction member 1 is bonded to the high conduction member 2 at a certain distance from the wire end 31 of the pigtail 3. As shown in FIG. 4B, there is a boundary layer of mixture of powders of the low conduction member 1 and the high conduction member 2.

The pigtail 3 is a strand that is comprised of a plurality of copper wires. The wire end 31 has a flat-cut head tightly anchored to the brush element 10. The wire end 31 is embedded in the high-conduction member 2 at a suitable depth from the upper-step side surface 22. Although the pigtail 3 is embedded in a portion remote from the contact surface 11, it is embedded in the high-conduction member at a certain distance from the other end surface 12 of the brush element 10.

Thus, the connection resistance of the pigtail is not so high even though the pigtail is inserted from the side of the low-conduction member 1. Moreover, the upper-step side surface 22 of the high-conduction member 2 to which the wire-end 31 of the pigtail 3 is embedded is not columnar shape that is covered with the low-conduction member 1. In other words, only the surface near the contact surface 11 is covered with the low-conduction member 1. Therefore, the connection resistance of the pigtail 3 and the deviation in the connection resistance are low. In addition, the brush can be manufactured through a simpler process than the prior art process.

Because the low-conduction member 1 and the high-conduction member 2 are bonded to each other tightly to form the boundary layer of mixture of powders of the low conduction member 1 and the high conduction member 2, both members would not be separated even if large current causes a high temperature. Thus, a reliable brush can be provided.

The brush is formed into a mold by a single punch (a single pressing-and-hardening step) as shown in FIGS. 5A–5F, from high-conduction powder 2' that forms the high-conduction member 2 and low-conduction powder 1' that forms the low-conduction member 1. Thereafter, the mold, with the wire end 31 being embedded therein, is sintered to form the brush element 10. That is, the brush element 10 is formed through steps of: filling high-conduction powder 2' into a female die 4 to form a step having a prescribed level difference on the surface 21' and 22' thereof; adding the low-conduction powder 1' to the lower step surface 21' to form a thin layer; pressing and hardening both the powders 1' and 2' to form a mold; and sintering the mold.

Figure 5A:
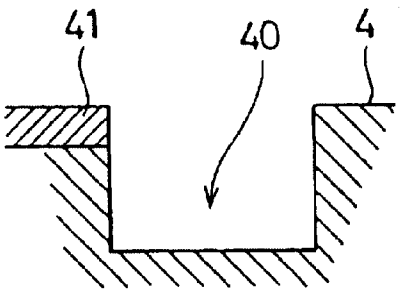
FIGS. 5A–5F are diagrams showing a series of manufacturing steps of the brush according to the first embodiment.
Figure 5B:
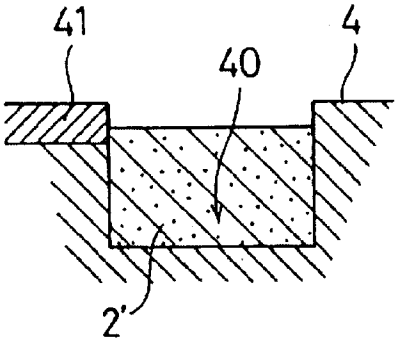
Figure 5C:
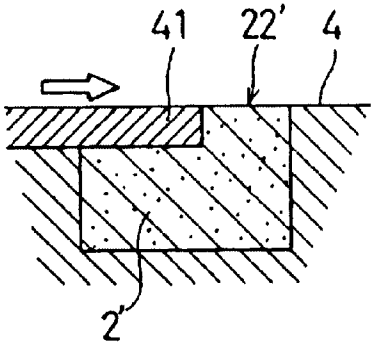
Figure 5D:
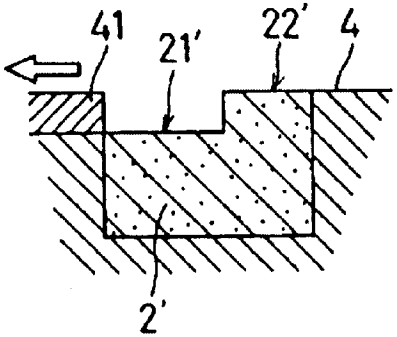
Figure 5E:
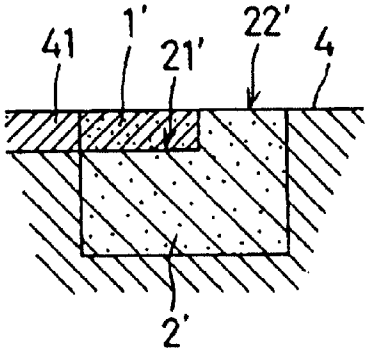
Figure 5F:
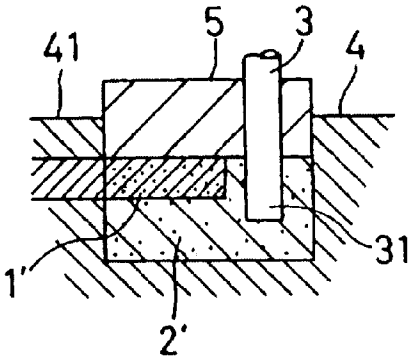

In more detail, the high-conduction powder 2' is filled flat into a concave portion 40 of the female die 4, as shown in FIG. 5B. Thereafter, as shown in FIGS. 5C–5D, a movable member 41 projects forward a certain distance from the female die 4 and turns back so that a surface portion of the high-conduction powder 2' is scraped up from one end thereof to form two steps 21' and 22'. As shown in FIG. 5E, the low-conduction powder 1' is added on the lower step 21' so that the low-conduction powder 1' can be flush with the surface of the high-conduction powder 2'. Thereafter, a male die that holds the wire end 31 straight is inserted into the female die 4 and pressed to thrust the end 31 into the high-conduction powder 2', thereby pressing the low-conduction powder 1' and the high-conduction powder 2'.

Thus, the high-conduction powder 2' and the low-conduction powder 1' are formed into a mold at the one-punch step, and the end 31 of the pigtail 3 is fixed in the hardened high-conduction powder 2'. Thereafter, the mold with the wire-end 31 is taken out of the female die 4 and sintered to form the sintered brush element 10.

Figure 6A:
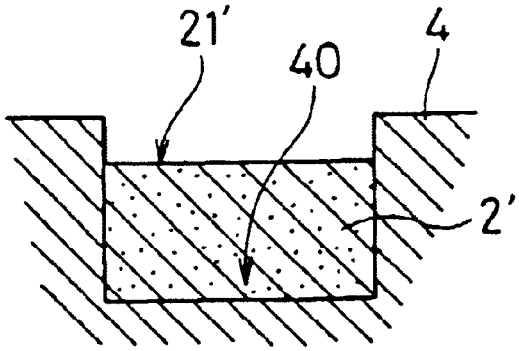
FIGS. 6A–6D are diagrams showing a series of manufacturing steps of the brush according to a first variation of the first embodiment.
Figure 6B:
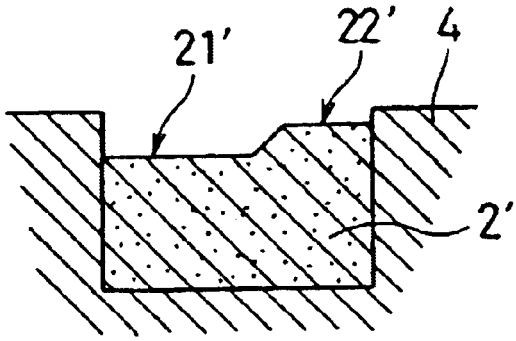
Figure 6C:
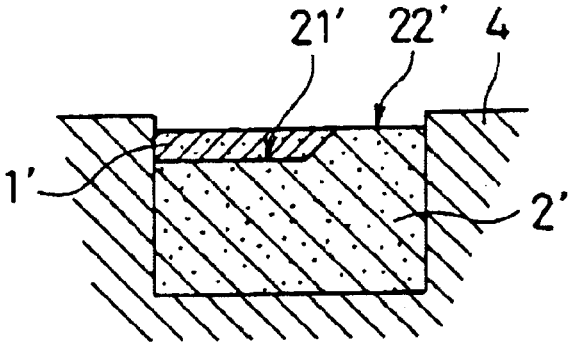
Figure 6D:
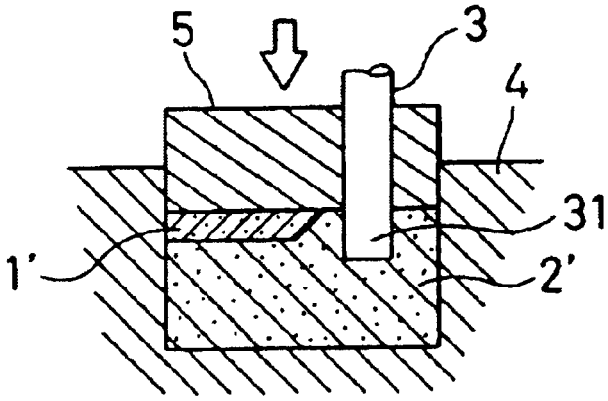

A first variation of the first embodiment is shown in FIGS. 6A–6D. This process of manufacturing the brush includes the steps of: filling the high-conduction powder 2' flat in the female die, as shown in FIG. 6A, and adding the high-conduction powder 2' thereto to cover a portion of the flat surface to form a platform or step, as shown in FIG. 6B. Thereafter, steps shown in FIGS. 6C–6D that are the same as the first embodiment follow.

In forming the platform or step of the high-conduction powder, the high-conduction powder 2' is filled flat in the female die 4 first. Thereafter, another high-conduction powder 2' is added to cover a portion of the flat surface of the high-conduction powder 2', thereby forming lower step 21' and upper step 22'. Therefore, no movable member 41 is necessary, so that the female die can become simpler.

In this variation, the fringe of the post-formed upper step 22 slides by itself to form not a sharp step but a roundish slope. Therefore, stress at the corner of the brush as a good can be moderated and the strength thereof is increased.

In a second variation of the first embodiment, a peripheral portion of the pigtail 3 is embedded in a side surface portion of the high-conduction member 2 that is behind the contact surface 11 remote from the low-conduction member. In other words, a half or more portion of the outer periphery of the pigtail 3 is embedded in the surface portion of the high-conduction member 2, and the other peripheral portion of the pigtail 3 is embedded in the low-conduction member 1.

Since the portion of the pigtail 3 surrounded by the high-conduction member 2 has a much smaller resistance than the other portion surrounded by the low-conduction member 1, the conductivity thereof does not much decrease. In addition, the thin low-conduction member 1 can be formed in the brush element 10 more freely so that less expensive brushes can be provided.

Figure 7:
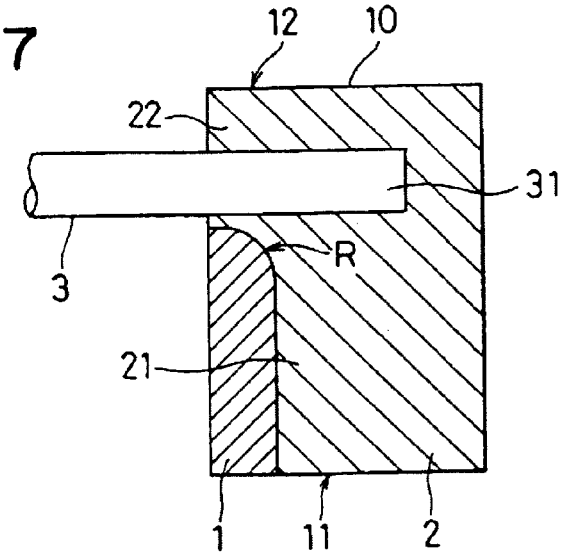
FIG. 7 is a longitudinal cross-sectional view of a brush according to a second embodiment of the invention.

The brush according to a second embodiment of the invention is shown in FIG. 7. The structure is almost the same as the first embodiment except a mild curve surface of the low-conduction member 1. The mild curved surface R has a suitable radius in contact with the high-conduction member 2. As a result, there is no concentration of stresses at the curved surface R, and the brush becomes stronger.

In addition, the brush can be manufactured in a simple process as described below, and less expensive brushes than the first embodiment can be provided.

Figure 8A:
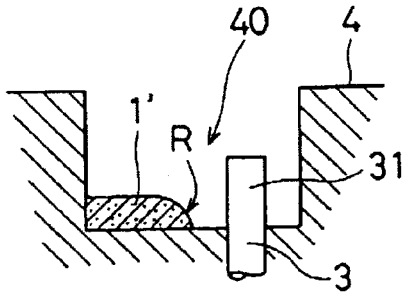
FIGS. 8A–8B are diagrams showing a series of manufacturing steps of the brush according to the second embodiment.
Figure 8B:
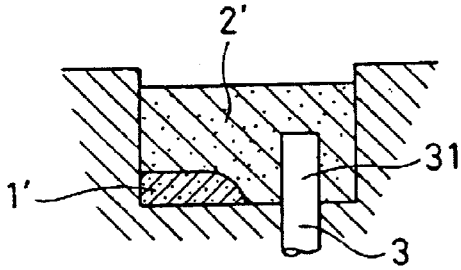
Figure 8C:
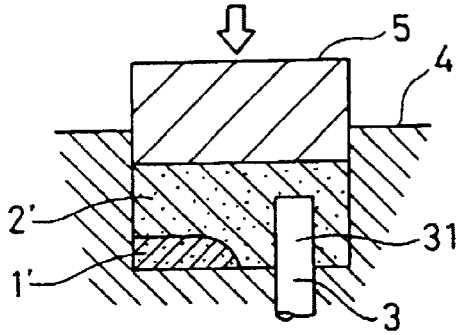

As shown in FIGS. 8A–8C, the brush element 10 is formed through the steps of: filling the low-conduction powder 1' to a prescribed thickness to cover the bottom of the female die 4 from an end to the middle thereof, adding the high-conduction powder 2' thereon, pressing the powders 1' and 2' to form a mold and sintering the mold.

As shown in FIG. 8A, the low-conduction powder 1' is filled to form a layer of a suitable thickness to cover the bottom surface of the female die 4 from a peripheral edge to the middle thereof. The surface area covered by such a thick layer of the low-conduction powder 1' corresponds to a maximum amount of abrasion of the brush. The front edge of the layer of the low-conduction powder 1', at the middle of the bottom, forms a slope having a curved surface of a suitable radius by itself due to gravity. The front edge (the bottom thereof) of the slope of the low-conduction powder 1' extends beyond a portion corresponding to the maximum abrasion amount. However, there is a suitable distance between the low-conduction powder 1' and the pigtail 3 to separate from each other.

As shown in FIG. 8B, the pigtail 3 is extended straight from the bottom of the female die 4 so that the high-conduction powder 2' can be filled to cover both the wire end 31 and the low-conduction powder 1'. Different from the step of inserting the pigtail 3 into the high-conduction powder 2' that has been filled beforehand, the high-conduction powder 2' is filled to cover the wire end 31. Even if the wire end 31 extends longer than the end of the first embodiment, the high-conduction powder 2' is scattered from above so that the high-conduction powder 2' can be filled around the end 31 of the pigtail 3 easily. As a result, the high conduction powder 2' completely covers the periphery of the pigtail 3 and the low conduction powder 1' to form a flat surface of the high-conduction powder 2.

As shown in FIG. 8C, the male die 5 is fitted in the female die 4 to press the low-conduction powder 1' and the high conduction powder 2'. Thereafter, the mold is taken out of the female die 4 and sintered.

Because the low-conduction powder 17 is filled in the female die to cover a certain area before the high-conduction powder 27 is filled therein, the lower surface of the high-conduction powder 2' forms a natural slope.

As a first variation of the second embodiment, the brush corresponding to the second variation of the first embodiment can be applied. This variation has the same effects as the second variation of the first embodiment.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention is to be regarded in an illustrative, rather than a restrictive, sense.

What is claimed is:

1. A method of manufacturing a brush element of a rotary electric machine to be brought by a spring in contact with a commutator, said method comprising the steps of:

filling a first conduction powder into a female die to form a stairs shape having a higher step and a lower step;

adding a second conduction powder that has lower conductivity than said first conduction powder to said lower step so that a surface of said second conduction powder can be flush with a surface of said first conduction powder thereby forming a layer of said second conduction powder having a thickness that corresponds to a difference between said higher step and said lower step;

pressing and hardening said first and second conduction powders by a single punch to form a mold; and sintering said mold, wherein said step of filling said first conduction powder comprises a step of filling said first conduction powder flat into said female die and a step of scraping a surface portion of said first conduction powder by a movable member to form said step.

2. The method as claimed in claim 1, wherein said pressing and hardening step further comprises a step of inserting a male die that holds a pigtail at its end into said first conduction powder.

3. The method as claimed in claim 2, wherein at least a half of said pigtail is embedded in said first conduction powder.

* * * * *